US006672231B2

(12) United States Patent
Shibata

(10) Patent No.: US 6,672,231 B2
(45) Date of Patent: Jan. 6, 2004

(54) SEWING MACHINE WITH EMBROIDERY FRAME SUPPORT

(75) Inventor: Masanori Shibata, Ichinomiya (JP)

(73) Assignee: Kabushikikaisha Barudan, Aichi-ken (JP)

( * ) Notice: Subject to any disclaimer, the term of this patent is extended or adjusted under 35 U.S.C. 154(b) by 0 days.

(21) Appl. No.: 10/334,450

(22) Filed: Dec. 30, 2002

(65) Prior Publication Data

US 2003/0209181 A1 Nov. 13, 2003

(30) Foreign Application Priority Data

May 13, 2002 (JP) ..... 2002-137665

(51) Int. Cl.[7] ..... D05C 9/04
(52) U.S. Cl. ..... 112/103
(58) Field of Search ..... 112/103, 470.31, 112/470.33, 470.14, 121, 475.18, 475.11; 38/102.2, 102.91

(56) References Cited

U.S. PATENT DOCUMENTS

| | | | | | |
|---|---|---|---|---|---|
| 4,665,844 | A | * | 5/1987 | Shibata | 112/103 |
| 5,553,560 | A | * | 9/1996 | Tajima et al. | 112/103 |
| 5,915,314 | A | * | 6/1999 | Moore, III | 112/103 |
| 6,119,609 | A | * | 9/2000 | Kawaguchi et al. | 112/103 |
| 6,279,498 | B1 | * | 8/2001 | Hattori et al. | 112/103 |
| 6,532,882 | B1 | * | 3/2003 | Tajima et al. | 112/103 |

FOREIGN PATENT DOCUMENTS

| | | |
|---|---|---|
| WO | WO 00/53836 | 9/2000 |

* cited by examiner

*Primary Examiner*—Ismael Izaguirre
(74) *Attorney, Agent, or Firm*—Darby & Darby

(57) ABSTRACT

The present invention provides a fabric tensing device for stretching fabric on a sewing machine.

4 Claims, 11 Drawing Sheets

SEWING MACHINE WITH EMBROIDERY FRAME SUPPORT

BACKGROUND OF THE INVENTION

1. Field of the Invention

The invention relates to a sewing machine which stretches a work fabric on a cylindrical frame.

2. Description of the Related Art

A cylindrical sewing frame is commonly used in embroidering a tube-like piece of fabric such as material for socks and wrist bands. The cylindrical frame is placed to cover the outside of the cylinder bed. The cylindrical frame is driven in the axial direction and around its axis. A device for a sewing machine is disclosed in International Patent Publication Number WO00/53836 that is able to support the tube-like work fabric close to the point of stitching. The cylindrical frame of this device has a small diameter and guides the fabric near the outside of the cylinder bed.

The device of the prior art comprises a detachable guiding member 102 at the front end of a cylinder bed 101 as shown in FIG. 11. A cylindrical frame 104 is equipped with a sewing window 103. The guiding member 102 has an annular shape with a diameter that is slightly smaller than the inner diameter of the cylindrical frame 104 and is provided integrally with a needle plate part 105 and a mounting plate 106. The mounting plate 106 is located at the top specifically for the cylindrical frame 104. In sewing a tube-like piece of work fabric, the needle plate 105 supports the work fabric as the plate is exposed through the sewing window 103 while the inside of the guiding member 102 guides the cylindrical frame 104 parallel to the cylinder bed.

However, the needle plate part 105 built specifically for a cylindrical frame is provided as an integral part of the guiding member 102 in the sewing machine of the prior art. Therefore, it is necessary to replace the needle plate 105 to replace the cylindrical frame 104 with a different frame such as a rectangular frame, an annular frame, etc. The needle plate 105 is replaced by removing the guide member 102 and mounting another needle plate on the cylinder bed 101.

SUMMARY OF THE INVENTION

The present invention provides a sewing machine which does not require replacing the needle plate in order to replace a frame. The cylindrical frame is guided with a member independent of the needle plate so that the needle plate can be permanently installed for use with all kinds of sewing frames.

The cylindrical frame covers the outside of the cylinder bed and is driven in its axial direction and around its axis so that the work fabric stretched over the cylindrical frame can be stitched. A partial cylindrical surface on the guide member is concentric with the cylindrical frame and is located near the inner surface of the cylindrical frame. A bobbin case and a needle plate are located at the front end of the cylinder bed. A guide member is mounted on the cylinder bed located below the needle plate and guides the cylindrical frame from the inside.

The design of the guide member is not limited to a specific configuration or composition. The guide member can be constructed to prevent vibrations by enhancing the strength of the mount and can have a large area on the partial cylindrical surface. Specifically, the guide member can be formed in an open-ended rectangular shape comprising two side walls connected at the rear end and an open front end.

The connecting part of the guide member is mounted on the cylinder bed, and a bobbin case is installed between the two side walls. A partial cylindrical surface is formed on the outside of the side walls.

In this case, a protection cover can be provided on the guide member to prevent the bobbin case, which is a revolving member, from being exposed when the cylindrical frame is not in use. Additionally, the cover can be used as a guide for the cylindrical frame. Specifically, the protection cover can protect the bobbin case from underneath and is mounted detachably on the guide member so that it does not hinder the replacement of the bobbin. A partial cylindrical surface can be provided on the protection cover to have a curvature approximately equal to the curvature of the partial cylindrical surface of the guide member.

The needle plate can be prevented from catching the work fabric that is stretched over the cylindrical frame and can have a sufficiently wide area for supporting the work fabric. Specifically, a curved surface can be provided to face the inner surface of the cylindrical frame at the left and right shoulders of the needle plate respectively.

DETAILED DESCRIPTION OF THE PREFERRED EMBODIMENTS

Figure 1:
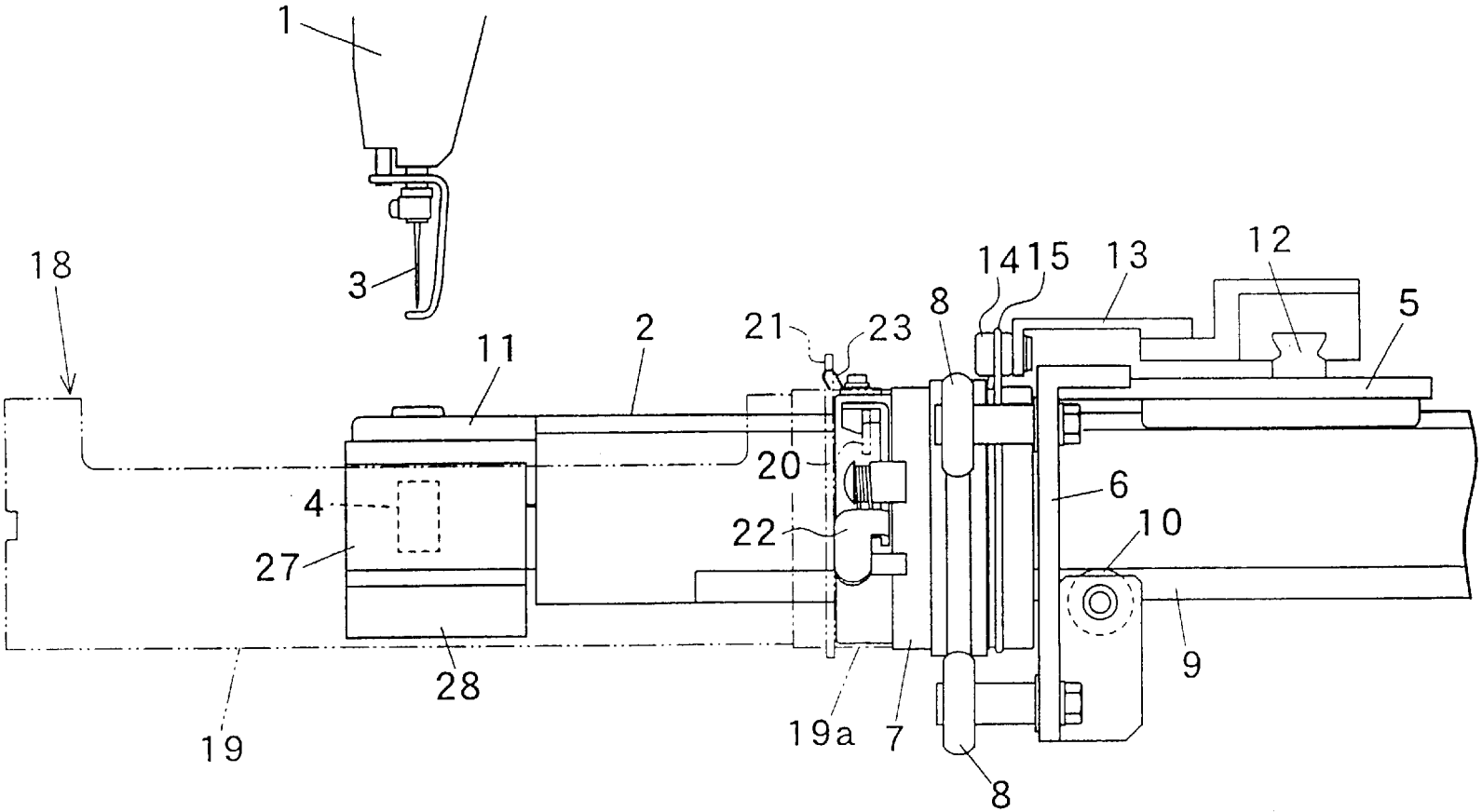
FIG. 1 is a side view of a cylinder bed according to an embodiment of the present invention.
Figure 2:
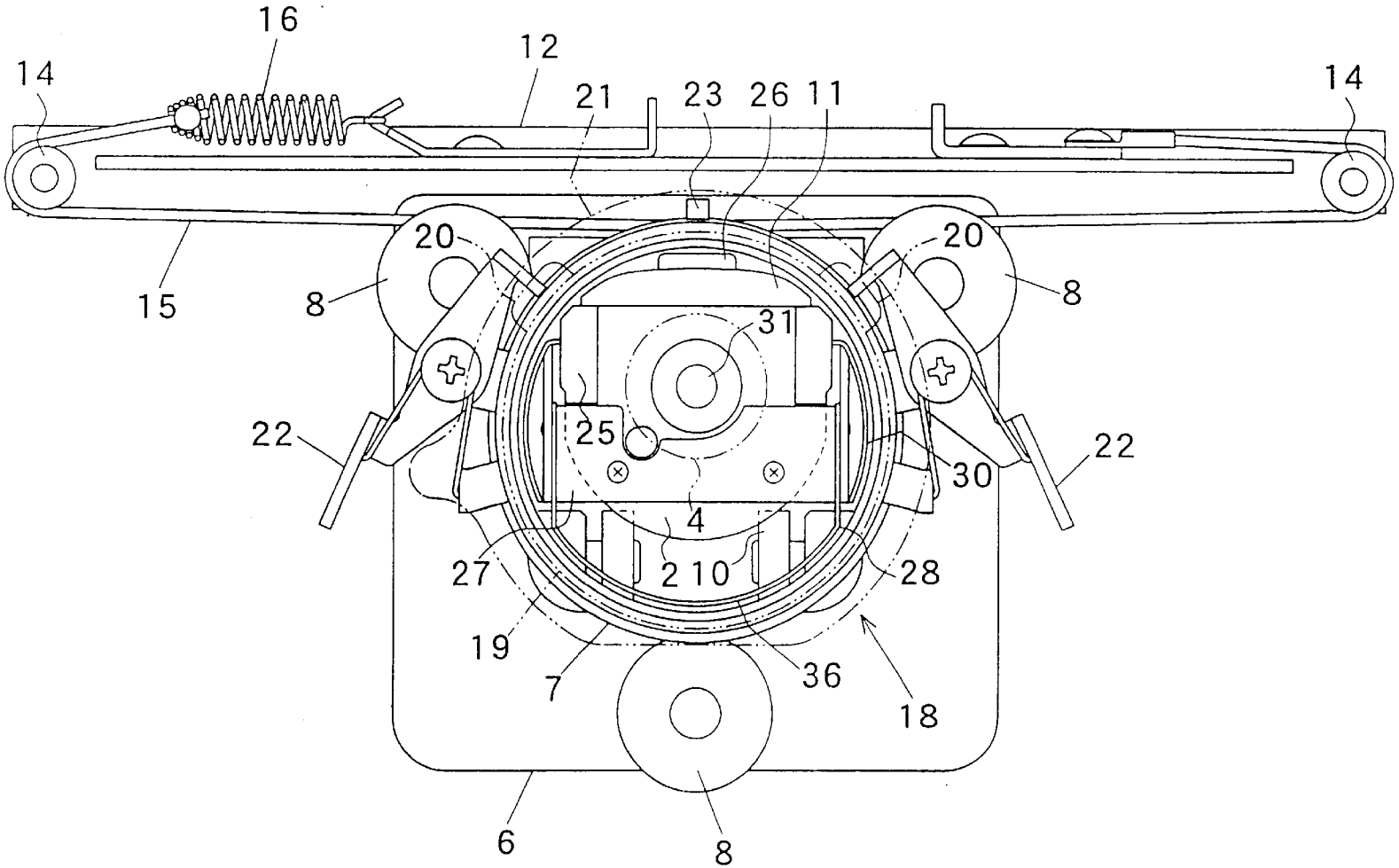
FIG. 2 is a front view of the bed according to an embodiment of the present invention.

An embodiment of the present invention on an embroidering sewing machine will be described below with reference to the accompanying drawings. A head 1 and a cylinder bed 2 are displaced in the vertical direction in the machine frame (not shown) of a sewing machine as shown in FIGS. 1–2. A needle 3 is attached to the bottom end of the head 1 while a bobbin case 4 and a needle plate 11 are provided at the front end of the cylinder bed 2. A Y-direction moving body 5 is supported by the top surface of the cylinder bed 2, and a base plate 6 is connected vertically to the moving body 5. Three rollers 8 are displaced on the front side of the base plate 6 in order to support a drive ring 7 while two guide rollers 10 are provided on the back side of the base plate 6 and engage two bottom grooves 9 on the left and right sides of the cylinder bed 2.

An X-direction moving body 13 is supported via a rail 12 provided on the top of the Y-direction moving body 5 while a pulley 14 is provided at the left and right ends of moving body 13, respectively. A wire rope 15 is provided on the pulleys 14 and is tightly stretched by means of a spring 16 while the rope 15 is wrapped around the middle of the drive ring 7. The Y-direction moving body 5 and the X-direction moving body 13 are connected to a sewing frame driving device (not shown) of the sewing machine, and the Y-direction moving body 5 strokes the drive ring 7 in a reciprocating manner in the axial direction (front and rear direction) of the cylinder bed 2 via the base plate 6 while the X-direction moving body 13 rotates the drive ring 7 in a reciprocating manner around the axis of the cylinder head 2 via the wire rope 15.

A cylindrical frame 19 of the fabric tensioning device 18 is placed to cover the outside of the cylinder bed 2 in an embroidering process of a piece of tube-like fabric such as material for socks and wrist bands. The cylindrical frame 19 is attached to the drive ring 7 via the rear end of the mounting part 19a. A latching piece 20 and a flange 21 are provided protrusively on the rear outer periphery of the cylindrical frame 19 while a lever 22 that engages with the latching piece 20 and a spring 23 that elastically contacts with flange 21 are provided on the drive ring 7. Thus, the cylindrical frame 19 is connected tightly to the drive ring 7 via the lever 22 and the spring 23. The cylindrical frame 19 and the drive ring 7 are driven together in the axial and circumferential directions relative to the axis of the cylinder bed 2 in order to sew the fabric stretched around the cylindrical frame 19 in the cooperation of the needle 3 and the bobbin case 4.

Figure 3:
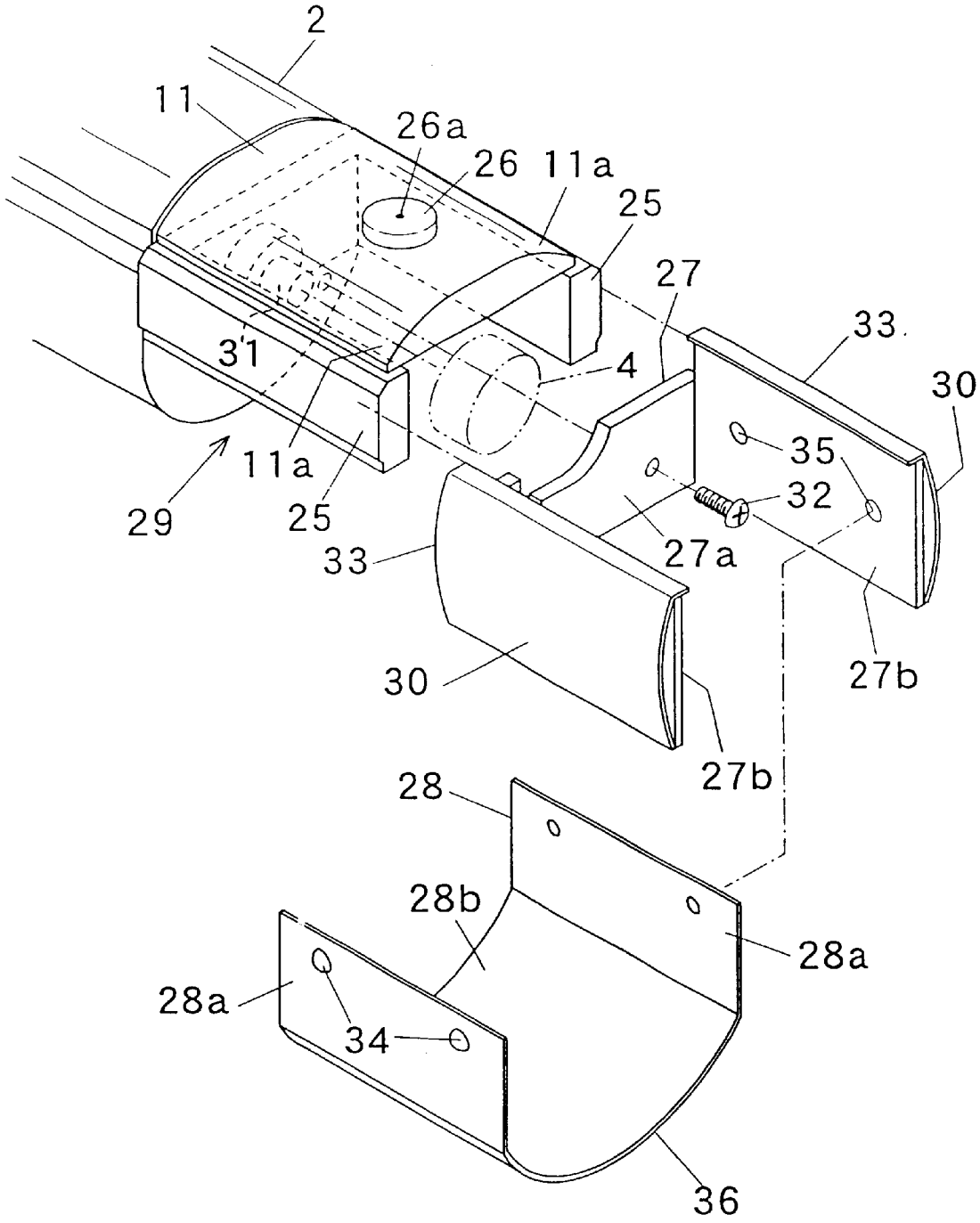
FIG. 3 is a disassembled perspective view showing a cylindrical frame guide device provided on the bed according to an embodiment of the present invention.
Figure 4:
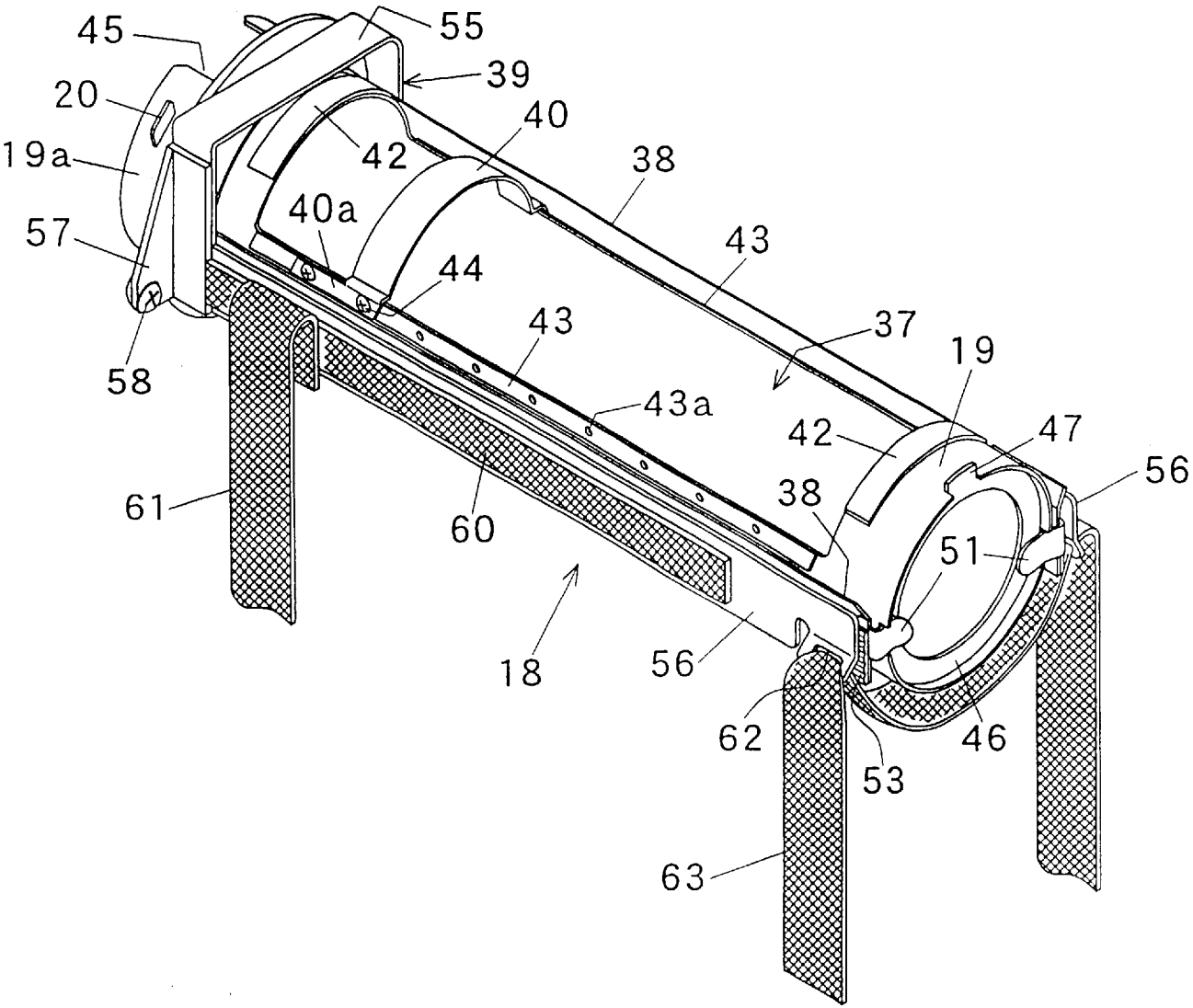
FIG. 4 is a perspective view of a fabric tensioning device of the bed according to an embodiment of the present invention.
Figure 5:
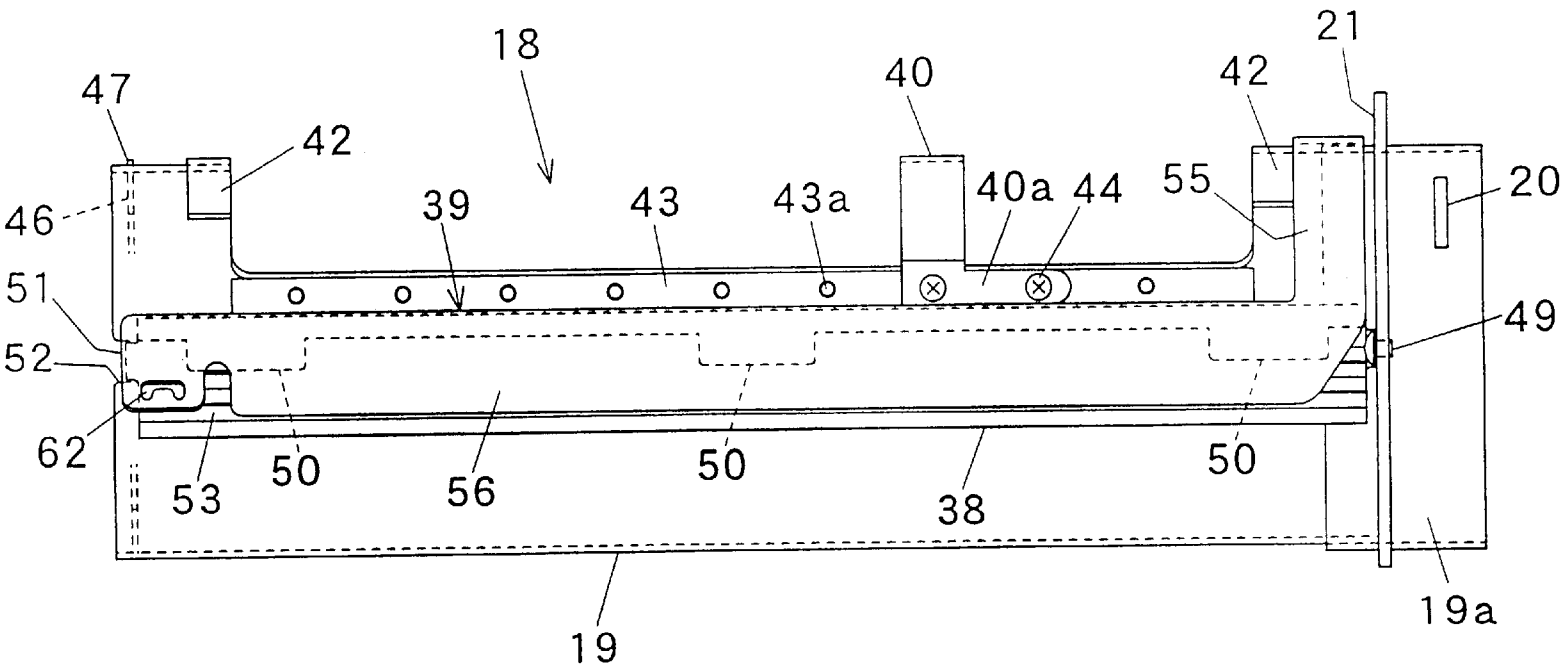
FIG. 5 is a side view of the fabric tensioning device according to an embodiment of the present invention.
Figure 6:
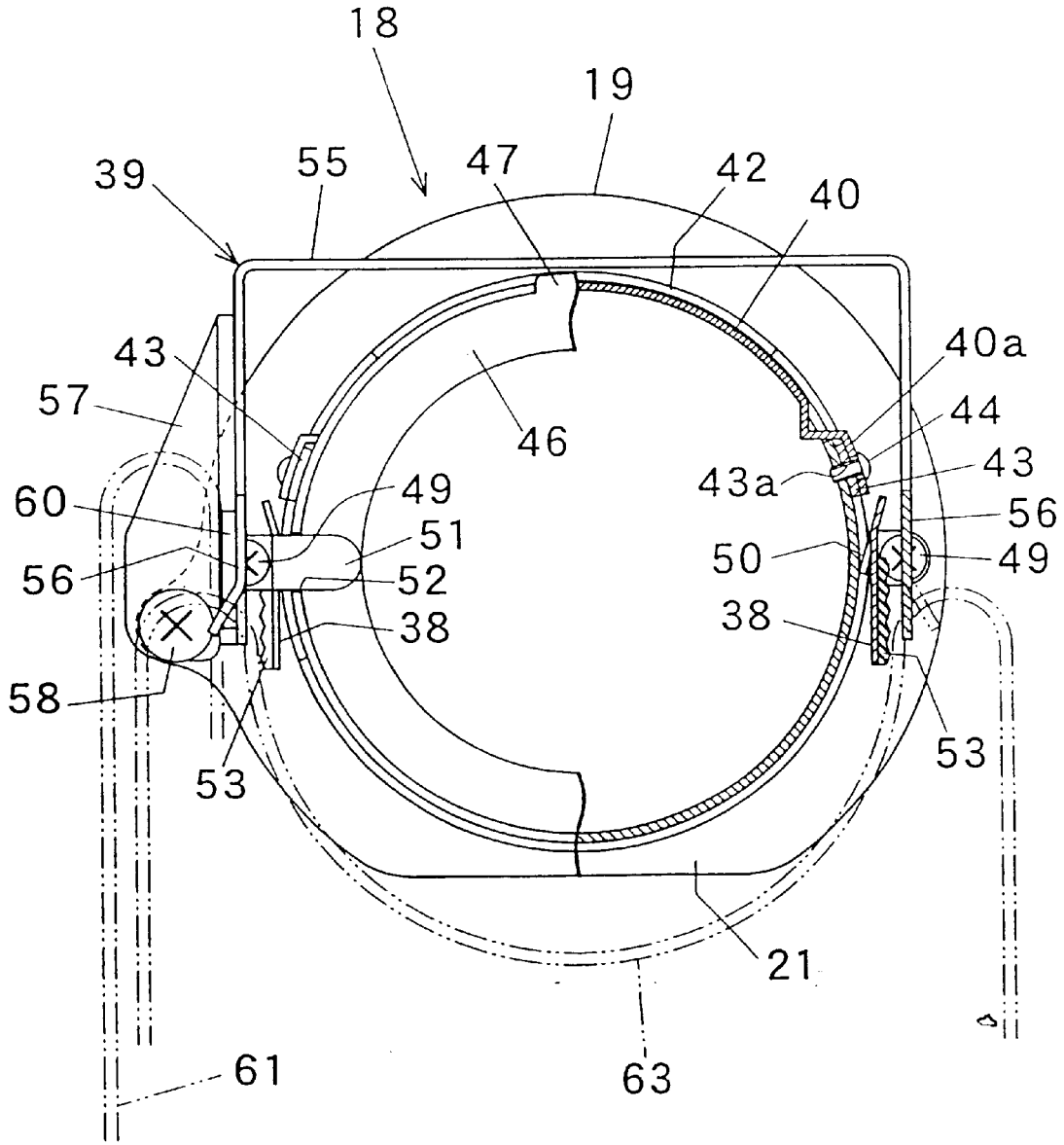
FIG. 6 is a partially broken front view of the fabric tensioning device according to an embodiment of the present invention.

A pair of arms 25 protrude on the left and right sides of the front end of the cylinder bed 2, and a needle plate 11 is affixed horizontally on arms 25 as shown in FIG. 3. Curved surfaces 11*a* are formed on the left and right shoulder areas of the needle plate 11 close to the inner surface of the cylindrical frame 19. A boss 26 equipped with a needle hole 26*a* protrudes low in the center flat area of needle plate 11. The front end of a bobbin case drive shaft 31 extends into an opening 29 formed below the needle plate 11, and the bobbin case 4 is mounted on the bobbin case drive shaft 31.

A guide member 27 is provided in opening 29 for supporting the cylindrical frame 19 from the inside. The guide member 27 consists of a connecting part 27*a* in the rear end and two side wall parts 27*b* on the left and right sides, together forming a rectangular shape. The connecting part 27*a* is affixed detachably with a screw 32 to the front end surface of the cylinder bed 2 below the bobbin case drive shaft 31. The side walls 27*b* cover the outside of the arms 25. A curved plate 33 is affixed by welding or the like on the outside of each side wall part 27*b*, and the curved plates 33 form a partial cylindrical surface 30 that contacts concentrically with the inside of the cylindrical frame 19 for the side wall parts 27*b*.

A protection cover 28 is provided below the guide member 27, and the cover 28 covers the bobbin case 4 from its underside. The protection cover 28 consists of flat parts 28*a* and a curved part 28*b* forming a U-shape as it is viewed from the front, wherein the curved part 28*b* forms a partial cylindrical surface 36 having the same curvature as the partial cylindrical surface 30 of the guide member 27 for the cover 28. Semispherical protrusions 34 are provided on the flat parts 28*a*while holes 35 are provided on the side walls 27*a* to fit the protrusions 34. The protection cover 28 is mounted detachably on the guide member 27 by means of fitting between the protrusions 34 and the holes 35 as the flat parts 28*a* are inserted on the inside of the side wall parts 27*b*.

The cylindrical frame 19 comprises a sewing window 37 that exposes the needle plate 11, a core material clamping member 38 that clamps down the core material C covering the sewing window 37 against the cylindrical frame 19, a fabric clamping member 39 that clamps down the work fabric W covering the core material C together with the core material C against cylindrical frame 19, and a support member 40 that supports the core material C and the work fabric W in the middle position of sewing window 37, as shown in FIGS. 4–7. The core material C is a shape-keeping material that prevents the work fabric W from sinking and is made of a material such as cardboard, unwoven fabric, etc. It is possible to sew by stretching the work fabric W directly over the cylindrical frame 19 without using the core material C if the work fabric W consists of a rigid material such as leather, felt, etc.

The sewing window 37 has a length corresponding to the axial stroke length of the cylindrical frame 19 while a slip guard 42 made of rubber is glued on the cylindrical frame 19 along the respective front and rear edges of the sewing window 37. A tightener 43 made of a steel strip or rubber is protrusively provided along the left and right side edges of the sewing window 37. A support member 40 is formed into a curved shape having a curvature approximately equal to that of the outside diameter of the cylindrical frame 19 and is fastened at fastening areas 40*a* at each end with screws 44 that are screwed into screw holes 43*a* of the tighteners 43 in an axially adjustable manner spanning over the sewing window 37. A notch 45 is formed on the rear mounting part 19*a* of the cylindrical frame 19 to allow the spring 23 of the drive ring 7 to enter. The inside of the front end of the cylindrical frame 19 is attached with an annular plate 46, and a portion of the annular plate 46 is provided with a protruding positive stop 47 for positioning the core C from the front end.

The core material clamping member 38 made of a steel strip is formed in an oblong shape in the axial direction, which is longer than the sewing window 37, on the left and right hand sides of the cylindrical frame 19 respectively under the tightener 43. The rear end of the core material clamping member 38 is affixed to the flange 21 with a screw 49 on the left and right sides of cylindrical frame 19 respectively while the front end of the core material clamping member 38 is provided in such a way as to be able to open individually to the left and right relative to the cylindrical frame 19. Clamping pieces 50 are provided at multiple places inside the core material clamping member 38 and bend in an angle going from top to bottom for elastically contacting the core material C. Temporary latches 51 bend inward at the front end of the core material clamping member 38 in such a way that the temporary latches 51 can elastically engage the annular plate 46 through notches 52 provided on the cylindrical frame 19 in order to hold the core material clamping member 38 temporarily in a closed state.

The fabric clamping member 39 comprises, on the left and right sides, a pair of fabric clamps 56 that are oblong in the axial direction and open at the front end. The rear ends of the left and right fabric clamps 56 are connected by a connecting part 55 thus causing the fabric clamping member 39 to have a substantially rectangular shape with an open-ended front. Each fabric clamp 56 is made of a steel strip having a length approximately equal to that of the core material clamping member 38, and the fabric clamps 56 face the core material clamping member 38 from the outside. Slip guards 53 are made of rubber plates with grooves and are intended to sandwich the work fabric W with the fabric clamps 56 that are glued on the outside of the core material clamping member 38. A bracket 57 is attached to the left side of the connecting part 55 which is made of a steel plate in a shape that spans the cylindrical frame 19. A threaded shaft 58 is provided on the bracket 57 on the outside of the left fabric clamp 56, and the fabric clamping member 39 is fastened to the flange 21 of the cylindrical frame 19 by means of the threaded shaft 58 so that the fabric clamping member 39 can open or close in the lateral (left and right) direction.

An oblong surface fastener tape 60 is adhered to the outside surface of each fabric clamp 56, and a surface fastener belt 61 with open ends is latched to the tape 60 in such a way as to be adjustable in the axial direction in order to coordinate with the support member 40. An engaging hole 62 is provided at the front end of the left and right fabric clamps 56, and a surface fastener belt 63 is threaded through the engaging hole 62. The left and right fabric clamps 56 and the left and right core material clamping members 38 can be tightened against the cylindrical frame 19 in the front and rear of the needle plate 11 where the sewing actions occur by means of the front and rear fastener belts 61 and 63. The surface fastener belts 61 and 63 can be provided with surface fasteners for the entire surface on the front and back or can be provided only on both ends.

The method of using the fabric tensioning device 18 in the sewing machine constituted as described above will be described as follows. In embroidering a piece of tube-like fabric, the cylindrical frame 19 is positioned to cover the outside of the cylinder bed 2, the mounting area 19*a* is fitted into the drive ring 7, the flange 21 is clamped to the spring 23, the lever 22 is engaged with the engaging piece 20, and the cylindrical frame 19 is mounted tightly on the drive ring 7, as shown in FIG. 1.

Figure 7:
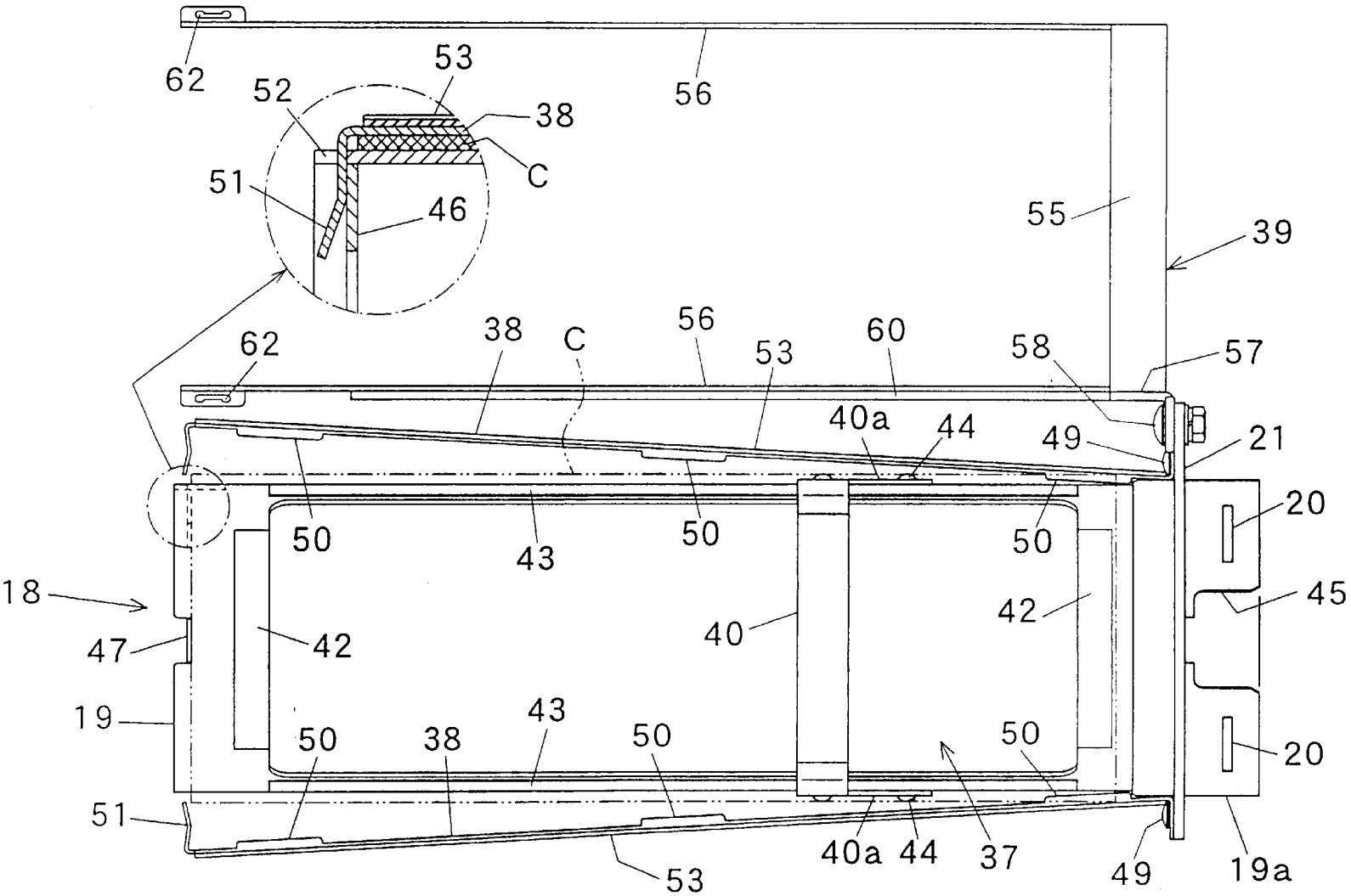
FIG. 7 is a plan view of the fabric tensioning device according to an embodiment of the present invention.
Figure 8:
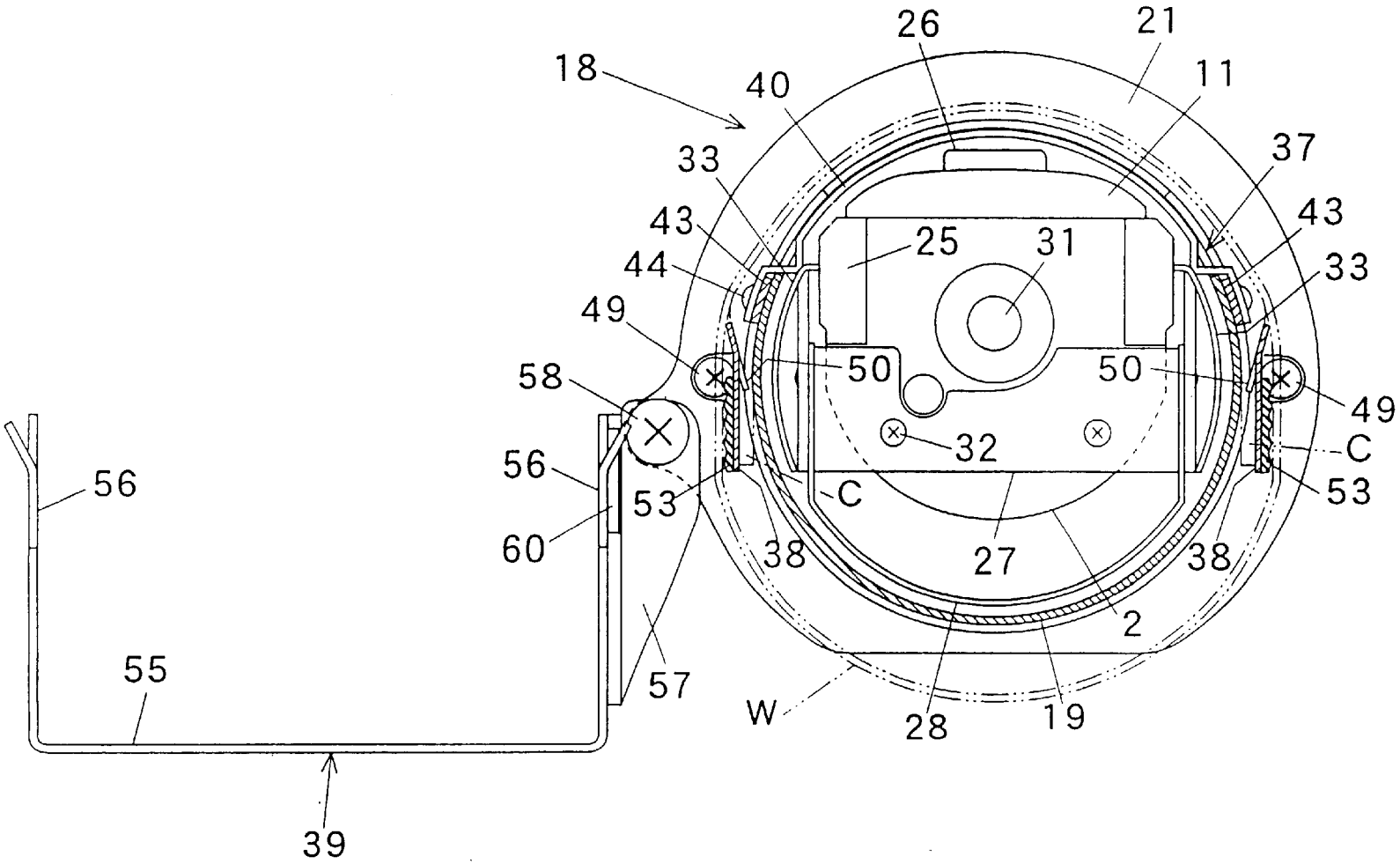
FIG. 8 is a cross-sectional view showing how a core material and a work fabric are mounted on a fabric tensioning device according to an embodiment of the present invention.

Next, the fabric clamping member 39 is opened toward the left side of the cylindrical frame 19, and the core material C is moved to abut against the positive stop 47, as shown in FIGS. 7–8. The core material C is supported by the supporting member 40, covers the sewing window 37, and is clamped down against the cylindrical frame 19 to be stretched by means of the core material clamping members 38 on the left and right sides. The following operating advantages can be achieved with the fabric tensioning device 18 of this embodiment:

(1) Since the two core material clamping members 38 on the left and right sides are attached to the cylindrical frame 19 in such a way as to be able to open independently, it is possible to clamp down the core material C against the cylindrical frame 19 on the left and right sides independently and align it against the outer periphery of the cylindrical frame 19 easily and accurately. The shape of the remaining portion of the core material C can be adjusted, and the right side of the core material can be clamped by the right core material clamping member 38 to stretch the entire core material C in a smooth cylindrical shape after clamping the left side of the core material with the left core material clamping member 38. The order of the steps can be reversed to start with the right side.

(2) Since the front ends of the left and right side core material clamping members 38 are arranged to be able to open toward the left and right sides of the cylindrical frame 19 respectively, the core material C is less likely to be stretched in a skewed manner and the material can be easily stretched against the cylindrical frame 19 evenly from the front to the rear at the same height. This is in contrast to the prior art wherein the clamping member opened and closed in the vertical direction.

(3) Since the temporary latches 51 are provided at the front end of the core material clamping member 38, the core material C can be held in a smooth, cylindrical shape by temporarily latching one side of the core material C, which makes it easy to adjust the other side of the work fabric W with both hands and to stretch it out neatly.

(4) Since the core material clamping members 38 are provided below the tighteners 43, it is possible to securely prevent the core material C from slackening and deformation while it is temporarily latched.

(5) Since the multiple clamping pieces 50 are provided in the inside of the core material clamping members 38, it is possible to hold various parts of the core material C with an even force using the core material clamping members 38 which are oblong in the axial direction.

Figure 9:
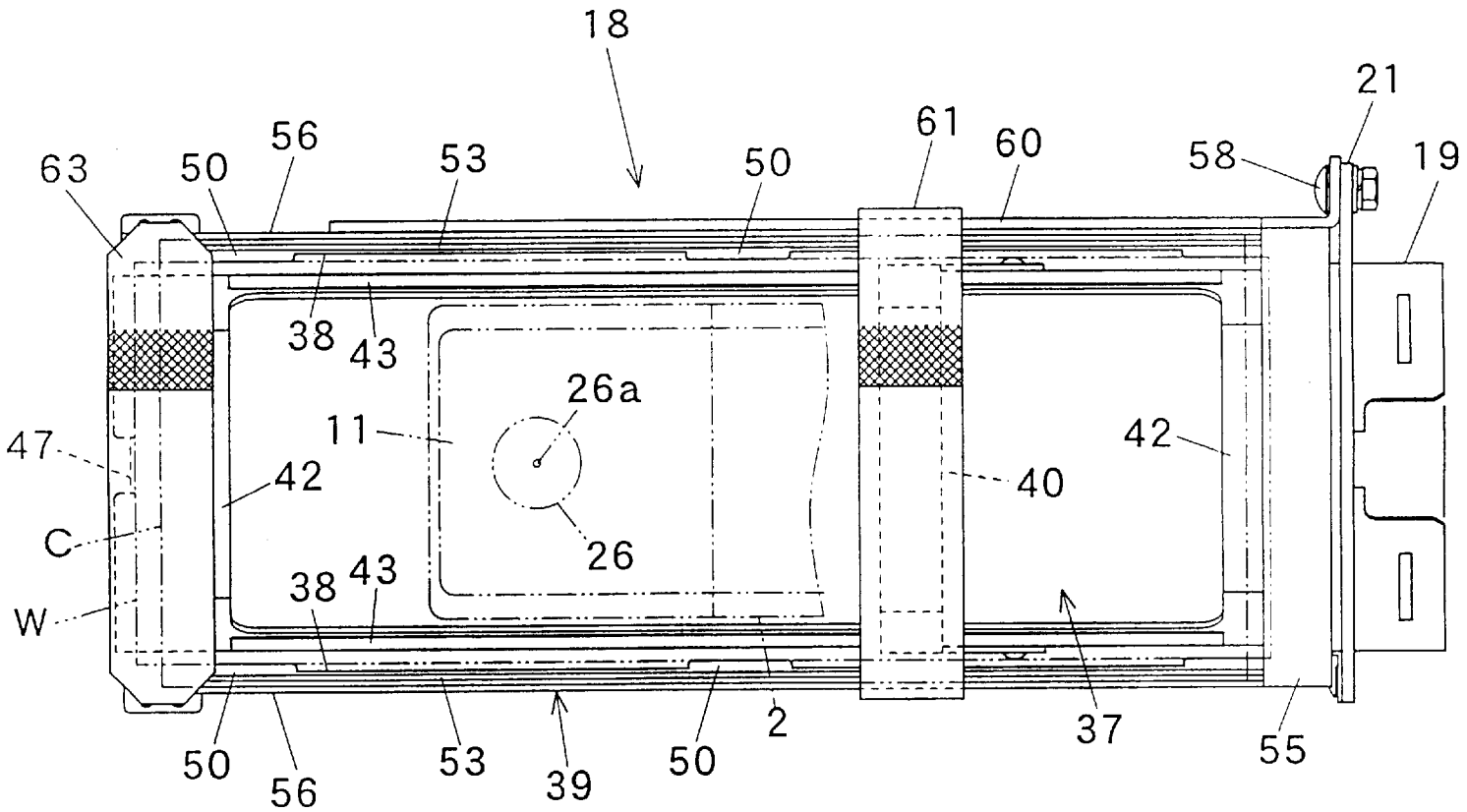
FIG. 9 is a plan view showing how a core material and a work fabric are tensioned according to an embodiment of the present invention.
Figure 10:
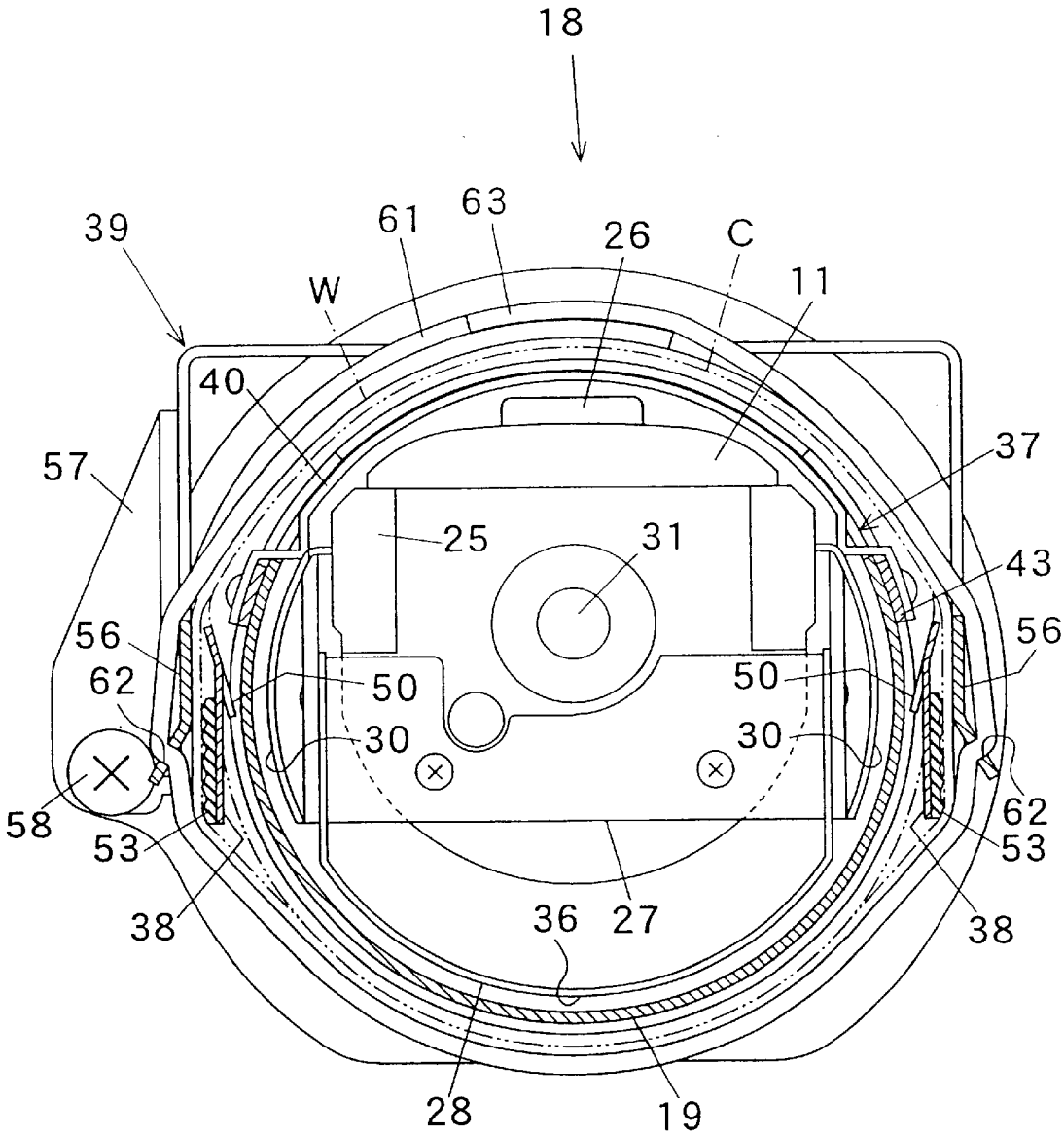
FIG. 10 is a cross-sectional view showing how a core material and a work fabric are tensioned according to an embodiment of the present invention.
Figure 11:
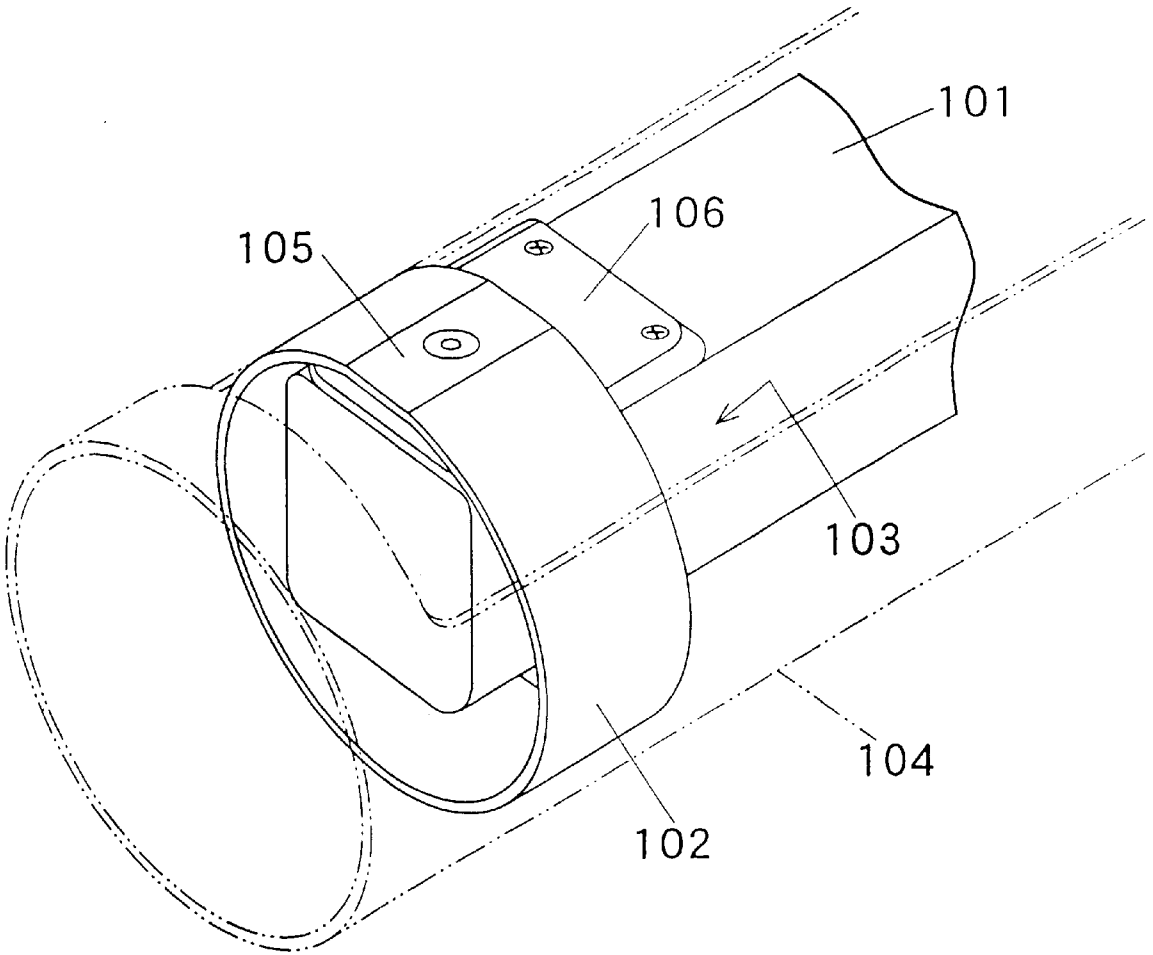
FIG. 11 PRIOR ART
FIG. 11 is a perspective view of a fabric tensioning device of the prior art.

Next, the work fabric W is placed on top of the core material C as shown in FIGS. 9–10. The fabric clamping member 39 is closed, and the work fabric W is clamped down against the cylindrical frame 19 via the core material C with the left and right fabric clamps 56. Next, both ends of the front and rear surface fastener belts 61 and 63 are moved to contact and stick together, and they are tightened in order to cause the fabric clamps 56 to tighten against the cylindrical frame 19 together with the core material clamping members 38 to stretch the work fabric W against the cylindrical frame 19. The following operating advantages can be achieved with the fabric tensioning device 18 of this embodiment:

(6) Since the two fabric clamps 56 on the left and right sides are tightened against the cylindrical frame 19 by means of the two front and rear surface fastener belts 61 and 63, the work fabric W is evenly clamped down on four sides of the needle plate 11, thus making it possible to stretch it out securely on the cylindrical frame 19 without causing any clamp marks or slack.

(7) Since the fabric clamping member 39 is provided in such a way as to be able to open or close in the lateral direction, the core material C and the work fabric W can be neatly and quickly spread out to cover the fully exposed sewing window 37 as shown in FIG. 7.

(8) Since the fabric clamping member 39 is pivot mounted on the flange 21 via the threaded shaft 58 located on the outside of the left side fabric clamp 56, it is possible to provide a wide space between the left side fabric clamp 56 and the cylindrical frame 19 when the fabric clamping member 39 is opened, thereby allowing the core material C and the work fabric W to be inserted easily in the space as shown in FIG. 8.

(9) Since the left and right fabric clamps 56 face the left and right core material clamping members 38 from the outside, they can be tightened together with two surface fastener belts 61 and 63 to hold the work fabric W and the core material C against the cylindrical frame 19 securely and simultaneously.

(10) Since the slip guards 53 are provided on the outside surfaces of the core material clamping members 38, the work fabric W can be clamped without slack between the core material clamping members 38 and the fabric clamps 56.

(11) Since the surface fastener belts 61 and 63 having open ends on one side are used, the fabric clamps 56 can be tightened by a one-touch operation without causing any slack.

(12) Since the rear surface fastener belt 61 is engaged with the surface fastener tape 60 in such a way as to be adjustable in the axial direction, it is possible to tighten the fabric clamps 56 closer to the back of the embroidering position as needed according to the embroidering pattern.

(13) Since the front surface fastener belt 63 is threaded through the engaging hole 62 of the fabric clamp 56, the belt 63 is less likely to get lost.

The following operating advantages can be achieved with the sewing machine of this embodiment:

(14) Since the cylindrical frame 19 is guided by means of the guide member 27, which is independent of the needle plate 11, it is possible to install the needle plate 11 permanently on the cylinder bed 2 in order to use the needle plate 11 not only for the cylindrical frame 19 but also for other types of frames such as a rectangular frame or an annular frame, thus eliminating the need to replace the needle plate 11 for different applications.

(15) Since the curved surfaces 11*a* are provided on the left and right shoulder areas of the needle plate 11 close to and facing the inner surface of the cylindrical frame 19, it is possible to feed the work fabric W smoothly without being stuck on the needle plate 11 and to provide a wide area on the needle plate 11 for supporting the work fabric W.

(16) Since the partial cylindrical surface 30 is formed on the left and right side walls 27*b* of the guide member 27 concentric and close to the cylindrical frame 19, the cylindrical frame 19 can be guided parallel to the cylinder bed 2 with high precision.

(17) Since the guide member 27 is formed in an open-ended rectangular shape, it is possible to attach the guide member 27 rigidly on the cylinder bed 2 via the connecting part 27*a*, thus effectively preventing vibration.

(18) Since the partial cylindrical surface 30 is formed on the left and right side walls 27*b* of the guide member 27, it is possible to install the bobbin case 4 and form a wide area for the partial cylindrical surface 30, thereby using the limited space under the needle plate 11 effectively.

(19) Since the protection cover 28 is provided detachably on the guide member 27, the bobbin case 4 is not exposed, thereby making it safer when the cylindrical frame 19 is not used. The bobbin case 4 can be removed or installed easily by removing the cover 28 during the bobbin exchange.

(20) Since the partial cylindrical surface 36 is formed on the protection cover 28, the guide surface 36 provides a wide surface for guiding the cylindrical frame 19 in cooperation with the partial cylindrical surface 30 of the guide surface 27.

This invention should not be construed to be restricted with the embodiment described above, but rather can be constructed in various other ways without leaving the gist of the invention as described below:

(a) To pivot-mount the fabric clamping member 39 by a shaft at the rear end so that it can open or close vertically;

(b) To form the entire structure of the fabric clamping member 39 with a rod material in an open-ended rectangular shape;

(c) To form a slit oblong in the axial direction in one of the fabric clamps 56 of the fabric clamping member 39, and cause the rear belt 61 to engaged the slit in such a way as to make its position adjustable;

(d) To form the core material clamping member 38 with a rod material in an oblong shape in the axial direction;

(e) To support rotatably the core material clamping member 38 at its rear end via a shaft and a spring mechanism relative to the cylindrical frame 19.

(f) To provide the core material clamping member 38 and the fabric clamps 56 in positions vertically separated on both the left and right sides of the cylindrical frame 19; and (g) To form a portion of the guide device for the cylindrical frame 19 that corresponds to the protection cover 28 integral with the guide member 27 and provide on the outside of the guide member 27 a partial cylindrical surface with an open portion at the top like a C-shape.

A sewing machine according to the present invention eliminates the need for detaching the needle plate since the needle plate is permanently installed and can be used for various types of sewing frames. The cylindrical frame is guided by a member which is independent of the needle plate.

What is claimed is:

1. A sewing machine for driving a cylindrical frame, said sewing machine comprising:

said cylindrical frame being adapted to hold fabric stretched thereover and having an inner surface, said cylindrical frame covering the outside of a cylinder bed having a front end, said cylindrical frame being adapted to be driven in the axial direction of said cylindrical frame and around the axis of said cylindrical frame;

a bobbin case having an underside and a needle plate provided at the front end of said cylinder bed;

a guide member guiding said cylindrical frame from the inside, said guide member being mounted on said cylinder bed, said cylinder bed being located below said needle plate; and a partial cylindrical surface on said guide member concentric to said cylindrical frame being formed in the proximity of the inside surface of said cylindrical frame.

2. A sewing machine as described in claim 1, wherein:

said guide member has an open-ended rectangular shape, said guide member comprising two side walls, a connecting part connecting the rear ends of said side walls, and an open front end;

wherein said connecting part is attached to said cylinder bed;

said bobbin case is stored between said side walls; and said partial cylindrical surface on said guide member is provided on the outside of said side walls.

3. A sewing machine as described in claim 1, further comprising:

a protection cover having an underside and an outside covering the underside of said bobbin case, said protection cover being attached detachably to said guide member; and a partial cylindrical surface on the outside of said protection cover having the same curvature as that of the partial cylindrical surface of said guide member.

4. A sewing machine as described in claim 1, further comprising:

a curved surface facing and located close to the inner surface of said cylindrical frame on the left and right shoulders of said needle plate respectively.

* * * * *